US007485789B2

(12) United States Patent
Gasull, III

(10) Patent No.: US 7,485,789 B2
(45) Date of Patent: Feb. 3, 2009

(54) ENHANCED RESONATOR FOR BANJO OR OTHER MUSICAL INSTRUMENT

(76) Inventor: H. Robert Gasull, III, 481 Foose Ridge Rd., Elliottsburg, PA (US) 17024

( * ) Notice: Subject to any disclaimer, the term of this patent is extended or adjusted under 35 U.S.C. 154(b) by 0 days.

(21) Appl. No.: 11/309,860

(22) Filed: Oct. 15, 2006

(65) Prior Publication Data

US 2007/0144330 A1 Jun. 28, 2007

Related U.S. Application Data

(60) Provisional application No. 60/727,376, filed on Oct. 17, 2005.

(51) Int. Cl.
*G10D 13/02* (2006.01)

(52) U.S. Cl. ..... 84/411 R; 84/272

(58) Field of Classification Search ..... 84/411 R, 84/269, 270, 272; D17/19
See application file for complete search history.

(56) References Cited

U.S. PATENT DOCUMENTS 529,514 A * 11/1894 Andres ..... 84/272

* cited by examiner

*Primary Examiner*—Walter Benson
*Assistant Examiner*—Jianchun Qin

(57) ABSTRACT

The enhanced resonator for banjo, or similar types of musical instruments, increases the comfort of playing a resonator banjo as an open back banjo. In addition, the 'open back' banjo sound quality is improved by allowing more sound to escape from the back and sides of the banjo. Furthermore, the enhanced resonator acts as a resonating chamber, increasing the sound quality in much the same way as the reflections of sound in a concert hall increase sound quality, increasing the reverberation and sustain of the sound. Another feature of the enhanced banjo resonator is the embodiment that allows the banjo player to easily and very quickly change the sound of the banjo from an open back banjo sound to a resonator banjo sound.

1 Claim, 8 Drawing Sheets

ENHANCED RESONATOR FOR BANJO OR OTHER MUSICAL INSTRUMENT

RELATED APPLICATIONS

The present application claims the benefit of U.S. Provisional Patent Application No. 60/727,376, filed Oct. 17, 2005.

OVERVIEW

The present invention of an enhanced resonator for banjo or other musical instruments is related to banjo or similar types of musical instruments, which will henceforth collectively be referred to as banjos, and more specifically to the resonators that are used to enhance the sound of a banjo or similar types of musical instrument.

Banjos are commonly produced as either an open back banjo, or as a resonator banjo.

The open back banjo produces a sound that is allowed to expand and emanate from the rear, or 'open back' of the banjo.

The resonator banjo produces a sound that is compressed and redirected within the interior of the resonator and banjo, and projected towards, and out of, the front of the banjo by the resonator that is attached to the back of the banjo. This will henceforth be referred to as the standard resonator banjo.

The standard resonator banjo commonly has a flange that is used to connect the resonator to the banjo, as will be familiar to those practiced in the art. At times the resonator is removed from the standard resonator banjo in order to have the standard resonator banjo produce a banjo sound similar to an open back banjo.

Two problems arise when the resonator is removed. First, the flange that is used to hold the resonator to the banjo can project into the player's body and thus creating discomfort to the player of the banjo. Second, the back of the banjo can be pushed close against the player's body and the sound escaping from the back of the banjo will be suppressed and muffled.

The open back banjo inherently has the problem of being pressed against the player's body and the resultant deadening or muffling of the sound, and thus a reduction in the quality of the open back banjo sound.

The present invention solves the problems of sound quality and comfort when the standard resonator banjo is being played with the resonator removed, that is as an open back banjo. The present invention also solves the sound quality problem of playing an open back banjo.

In addition the present invention also provides a means of easily varying the sound of a banjo from an open back banjo to a standard resonator banjo sound, while also increasing the comfort of playing a standard resonator banjo as an open back banjo.

To summarize, the enhanced banjo resonator increases the comfort of playing a standard resonator banjo as an open back banjo. The 'open back' banjo sound quality is improved because more of the sound is allowed to escape from the back and sides of the banjo because the banjo is held away from the banjo player's body, and the sound holes allow the sound to escape. Furthermore, the enhanced banjo resonator acts as a resonating chamber, increasing the sound quality in much the same way as the reflections of sound in a concert hall increase sound quality, increasing the reverberation and sustain of the sound. The sound is able to not just project out the front of the banjo, the sound is also able to project out all around the sides and back of the banjo as well. Another feature of the enhanced banjo resonator is the embodiment that allows the banjo player to easily and very quickly change the sound of the banjo from an open back banjo sound to a standard resonator banjo sound.

The present invention of an enhanced resonator for banjo, or similar type of musical instrument, can be used either as original equipment on a banjo, or as an addition, accessory, or alternative banjo resonator.

BRIEF DESCRIPTION OF THE DRAWINGS

The above and other objects, features and advantages of the present invention will become apparent from a consideration of the following detailed description in which.

SPECIFICATION

The following is a disclosure of several embodiments of the present invention of an enhanced resonator for banjo or other musical instruments.

Figure 1:
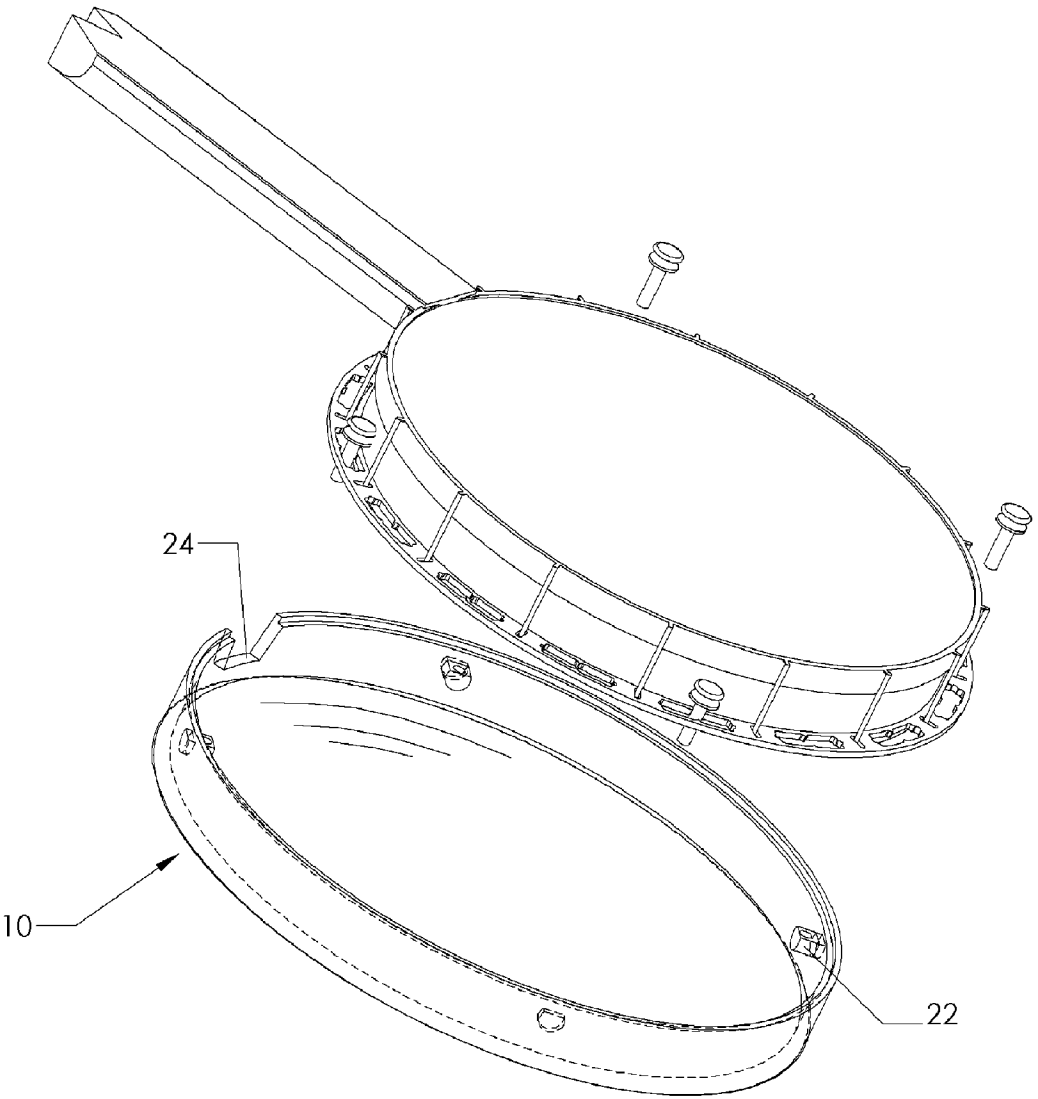
Fig. 1 Prior Art
FIG. 1—Shows a standard resonator from a standard resonator banjo with no opening in the sides or back of the resonator.

For comparison purposes a representative standard resonator from a standard resonator banjo is shown in FIG. 1. A standard resonator does not have holes in the back or sides of the resonator (10). The standard resonator does have a means of attaching the resonator to the banjo (22). The standard resonator may also have a cutout (24) in the resonator for the neck of the banjo.

Figure 2:
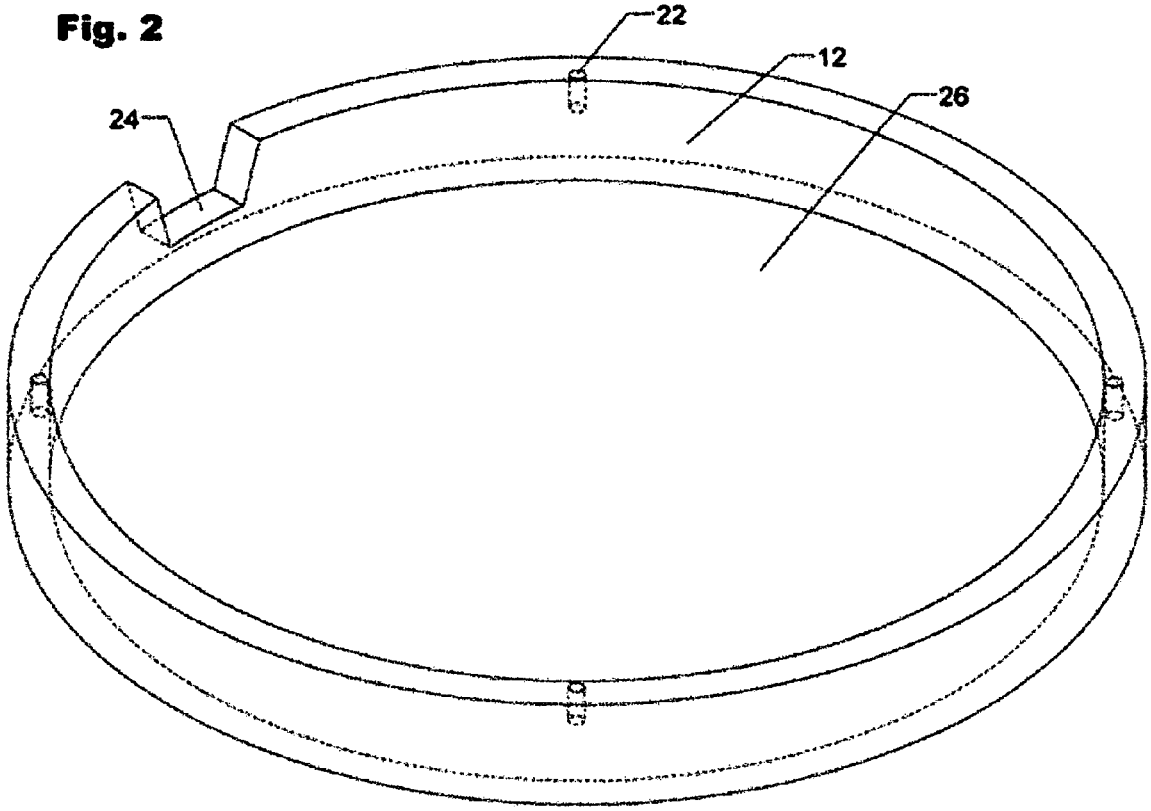
FIG. 2—Shows a basic enhanced banjo resonator with a fully open back.

The most basic embodiment of the enhanced banjo resonator is shown in FIG. 2. With this embodiment there are no holes in the side of the resonator (12). The back of the resonator (26) is open. There is a means of attaching (22) the enhanced banjo resonator to the banjo. If necessary, the enhanced banjo resonator has a cutout (24) for the neck of the banjo. The basic enhanced banjo resonator improves the comfort of playing a resonator banjo with the standard resonator removed. The basic enhanced banjo resonator also enhances and improves the quality of the sound of a standard resonator banjo being played as an open back banjo by increasing the size of the opening at the back of the banjo, and moving the open back of the banjo away from the body of the banjo player, which can suppress the sound, and thus allow more sound to project from the banjo with the basic enhanced banjo resonator attached.

Figure 3:
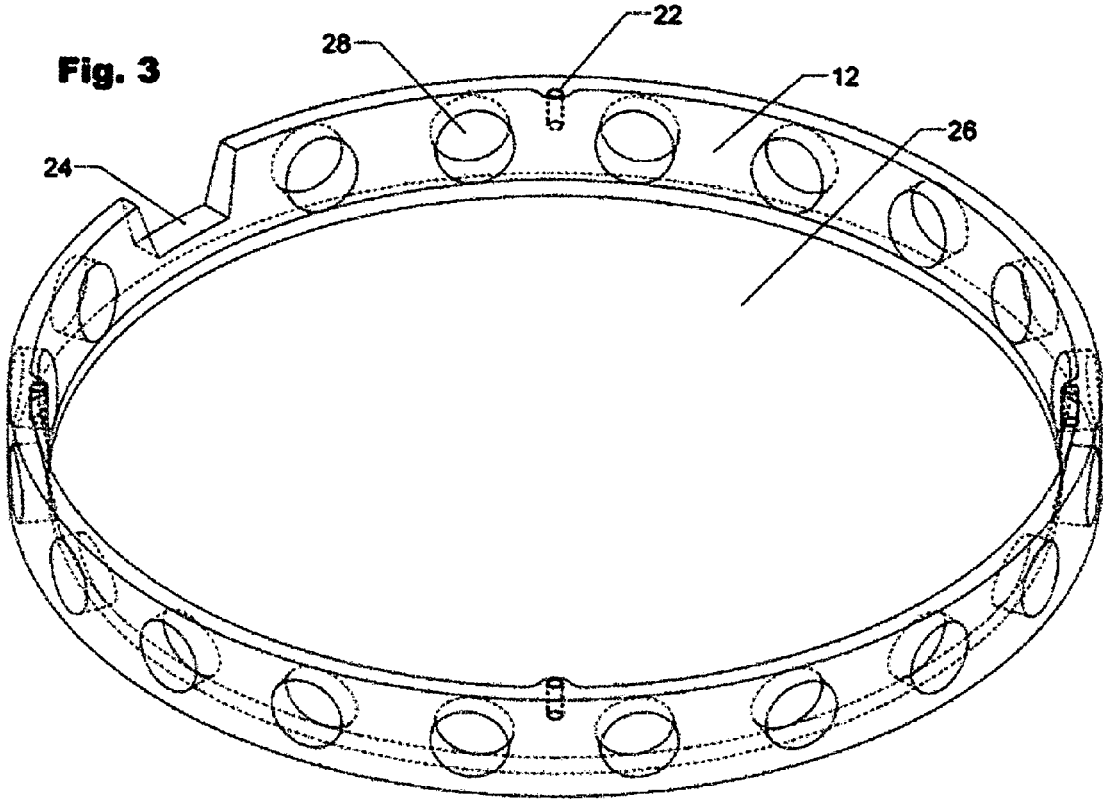
FIG. 3—Shows an enhanced banjo resonator with tapered sides and with holes in the sides of the resonator and a fully open back.

Another embodiment of the enhanced banjo resonator is shown in FIG. 3. This embodiment has holes (28) in the side of the resonator to allow more sound to be projected from the banjo. This embodiment also has tapered sides (12) on the interior edge of the enhanced banjo resonator. The tapered sides (12) serve to help project the sound of the banjo towards the front of the banjo through the holes normally found in the flange of the standard resonator banjo that is used to attach the resonator to the banjo, as will be familiar to those skilled in the art. This embodiment also has a means of attaching the enhanced banjo resonator to the banjo (22). There is also an optional cutout (24) in the enhanced banjo resonator for the banjo neck. The back (26) of the enhanced banjo resonator in this embodiment is open.

Though there are no figures depicting the following embodiment. It is possible to have an embodiment of the enhanced banjo resonator where the back of the resonator is not open and has no holes as with a standard resonator on a standard resonator banjo. The openings, or one or more holes, in the enhanced banjo resonator would only be in the side of the enhanced banjo resonator. The hole(s) in the side of the enhanced banjo resonator would serve the same purpose of allowing a banjo with a resonator attached to have an open back banjo sound, while still making the banjo more comfortable to play.

Figure 4:
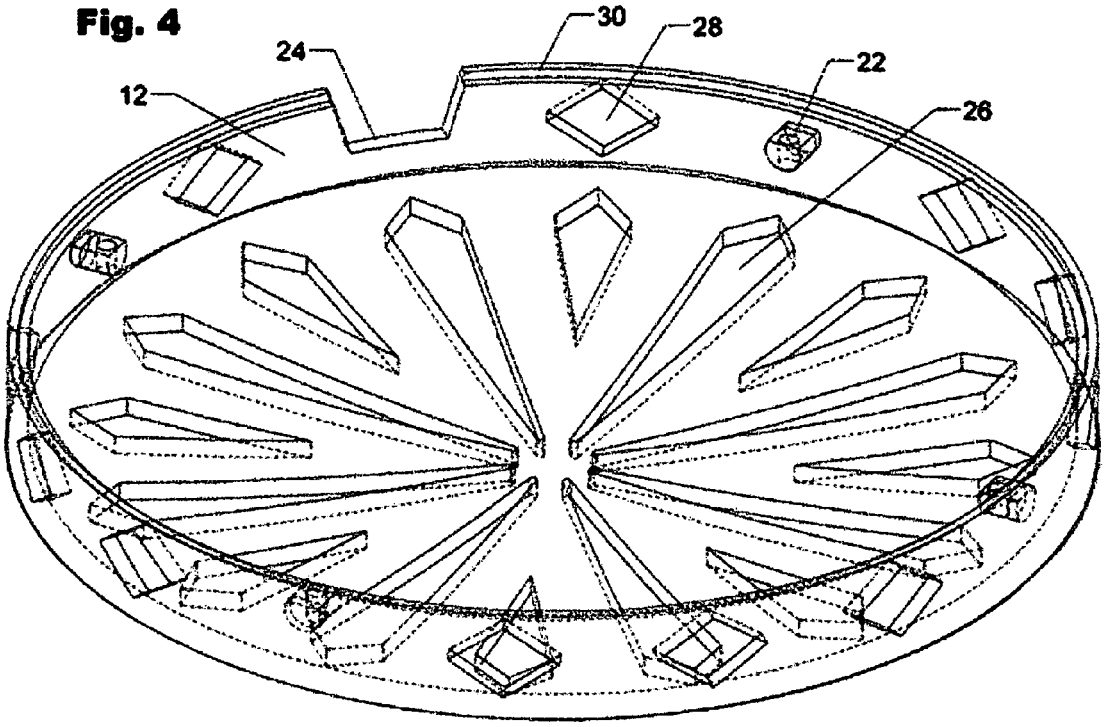
FIG. 4—Shows an enhanced banjo resonator with holes in the sides of the resonator and with a plurality of holes in the back of the resonator.

Another embodiment of the enhanced banjo resonator depicted in FIG. 4 has one or more holes (28) in the side of the resonator (12). This embodiment also has a one or more holes (26) in the back of the resonator. An optional feature depicted in this embodiment is a lip (30) on the edge of the resonator to fit around the flange on the banjo. As with the other embodiments, this embodiment has a means of attaching the resonator to the banjo (22), and an optional cutout (24) for the neck of the banjo. This embodiment also demonstrates that various shapes of holes can be used for the openings in the enhanced banjo resonator.

Figure 5:
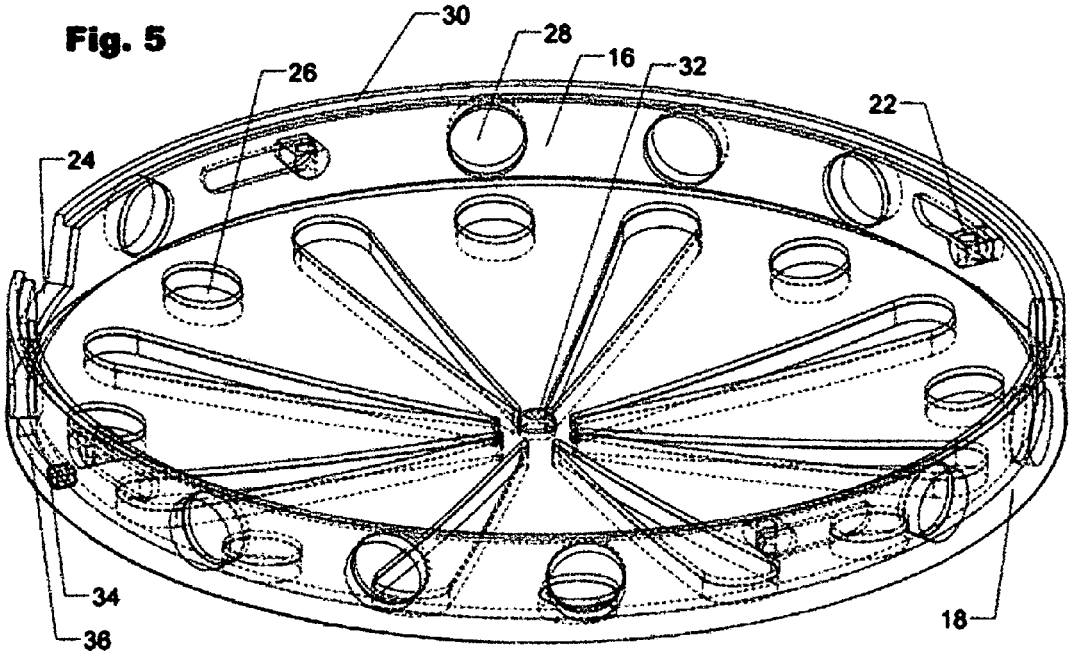
FIG. 5—Shows an adjustable enhanced banjo resonator with holes in the back and sides of the resonator, and with an inner and outer resonator shell, and a means to adjust the position of the inner resonator shell.

An adjustable enhanced banjo resonator is depicted in FIG. 5. The adjustable enhanced banjo resonator has the additional benefit of the ability to vary the sound of the banjo from an open back banjo sound to a standard resonator banjo sound without removing or exchanging the resonator on the banjo. The adjustable enhanced banjo resonator also increases the comfort of playing a standard resonator banjo in open back mode. The embodiment of the adjustable enhanced banjo resonator shown in FIG. 5 has a fixed outer resonator shell (18) that is attached to the banjo by the means (22) provided for example. This embodiment of the adjustable enhanced banjo resonator also has an inner resonator shell (16) that has an optional means to be held in place when rotated in relation to the outer resonator shell (18) for example as shown by an optional pin (32). In one position the one or more holes in the side (28) and/or back (26) of the inner (16) and outer (18) resonator shell are aligned, and the adjustable open back resonator emulates an open back banjo. In various alternate positions of the inner resonator shell (16) in relation to the outer resonator shell, (18) the sound of the banjo is varied from the open back banjo sound to the standard resonator banjo sound.

There is a means to rotate the inner resonator shell (16) within the outer resonator shell (18) as shown, for example, by the protrusion (34) that is connected to the inner resonator shell (16) through, for example, a slot (36) in the outer resonator shell (18). The means to position (34) the inner resonator shell (16) in relation to the outer resonator shell (18) is used to close the one or more holes or openings in the side (28) and/or back (26) of the adjustable enhanced banjo resonator. This allows the adjustable enhanced banjo resonator to vary the banjo sound from an open back banjo sound to a standard resonator banjo sound. Various means could be used to hold or fix the position of the inner (16) and outer (18) resonator shells in relation to each other.

As with the other embodiments, if needed, there is a cutout (24) in the resonator for the neck of the banjo. In addition, there are slots in the inner resonator shell (16) of the adjustable enhanced banjo resonator that allow the inner resonator shell (16) to be movably positioned within the outer resonator shell (18). As a means to suppress the vibrations that may occur between the inner (16) and outer (18) resonator shells a material, such as strips of felt or other material, may be used between the shells.

Other embodiments of an adjustable enhanced banjo resonator are possible. For example an embodiment where an inner resonator shell (16) is attached to the banjo and there is a movable outer resonator shell (18).

Figure 6:
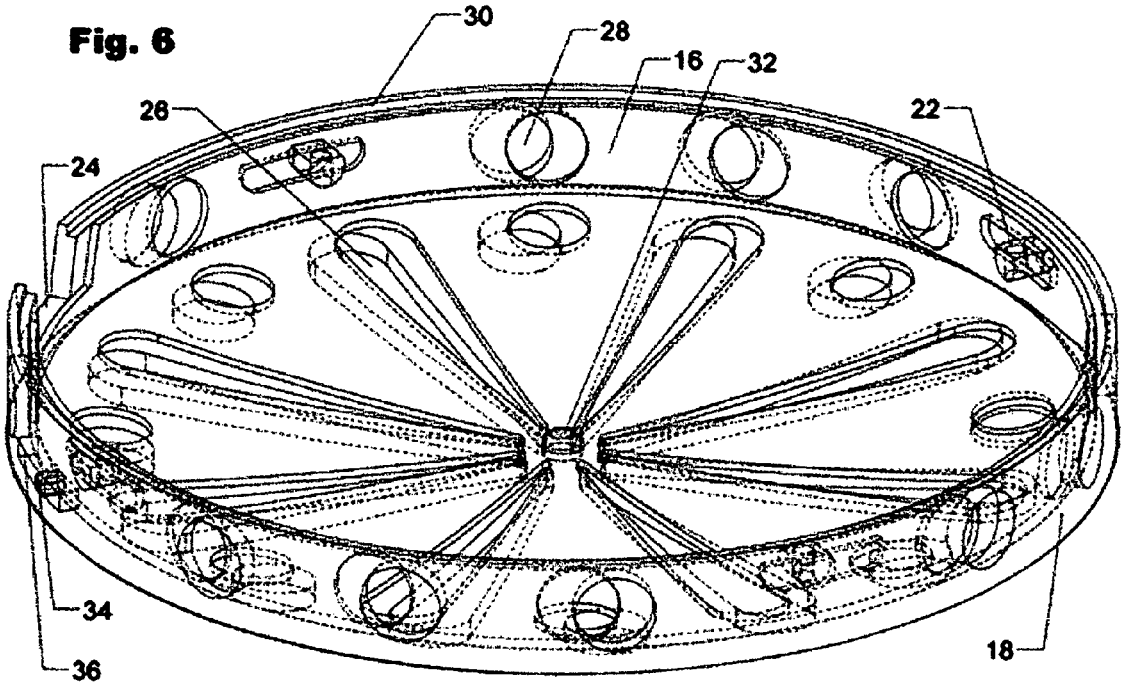
FIG. 6—Shows a view of an adjustable enhanced banjo resonator with the holes partially open, varying the banjo sound from the open back sound to the standard resonator sound.

FIG. 6 shows the adjustable enhanced banjo resonator with the holes in the inner (16) and outer (18) resonator shells partially aligned for producing a variation between open back banjo sound and the standard resonator banjo sound.

Figure 7:
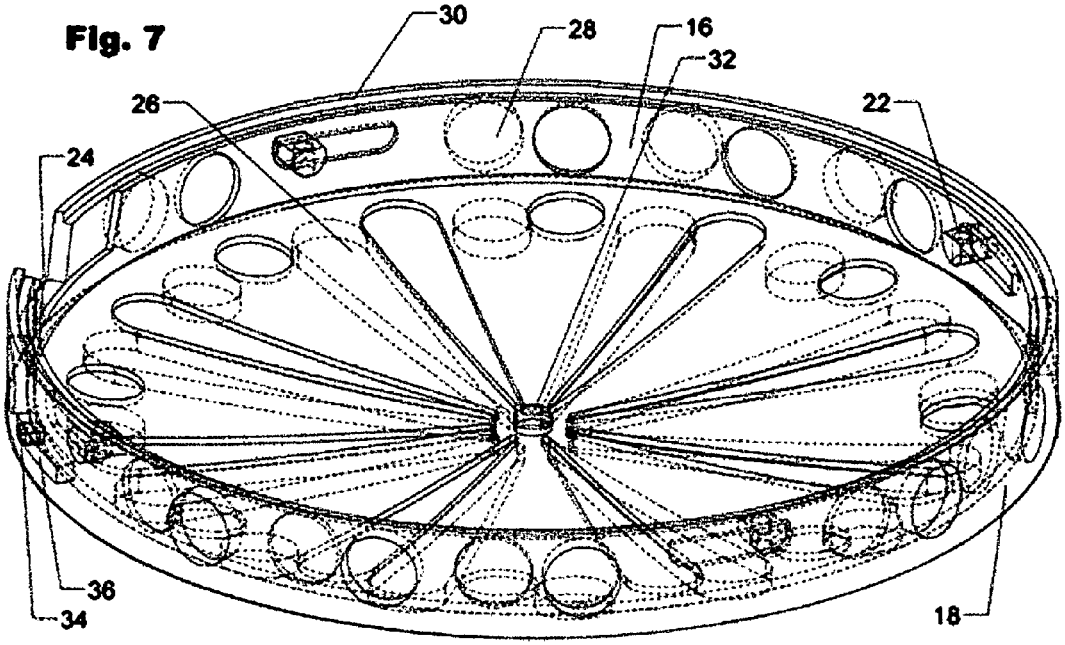
FIG. 7—Shows a view of an adjustable enhanced banjo resonator with the holes fully closed in order to produce the standard resonator banjo sound.

FIG. 7 depicts the adjustable enhanced banjo resonator with the holes in the inner (16) and outer (18) resonator shells fully closed for producing a standard resonator banjo sound.

Figure 8:
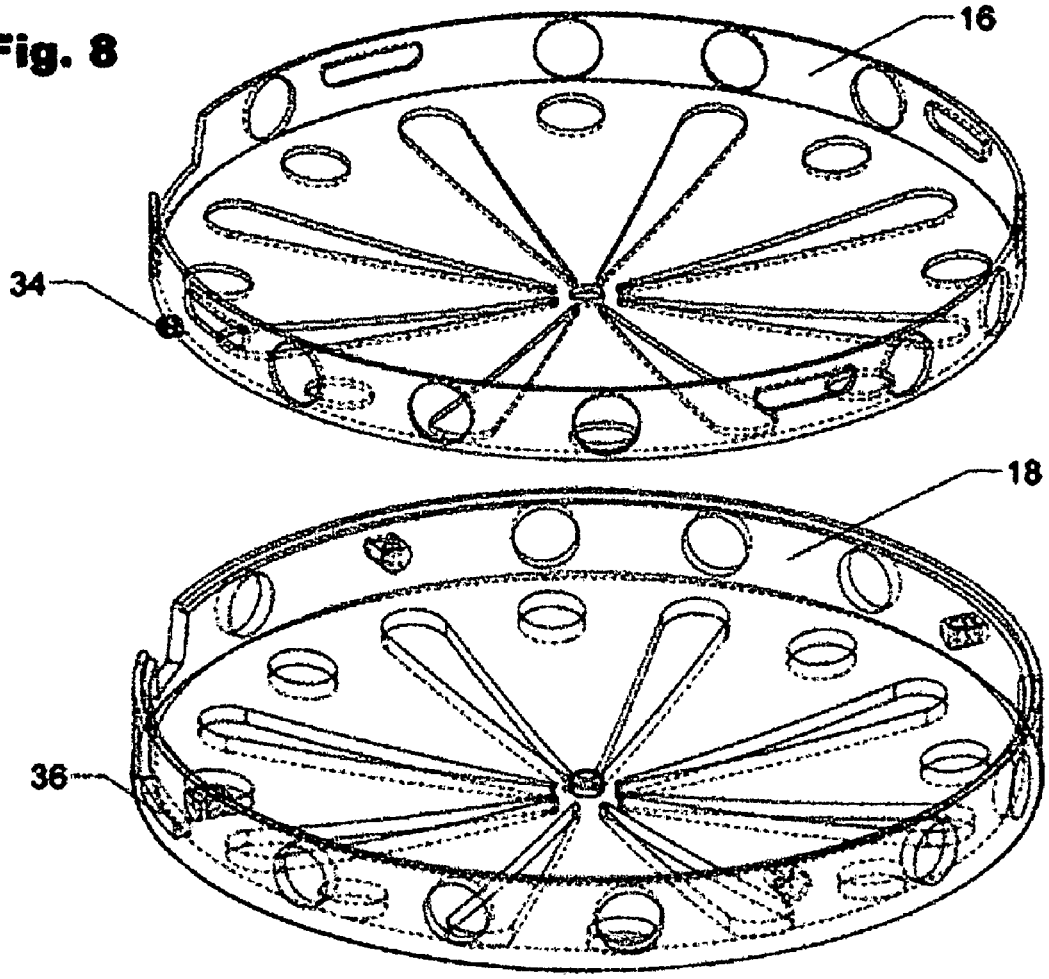
FIG. 8—Shows an exploded view of an adjustable enhanced banjo resonator.

FIG. 8 shows an exploded view of the adjustable enhanced banjo resonator with both the inner (16) and outer (18) resonator shells clearly visible as well as the means for moving (34) the inner resonator shell (16) within the outer resonator shell (18).

The invention is not limited to the embodiments disclosed but also covers all equivalent embodiments that are in the spirit of the invention. For example an alternate embodiment of the enhanced banjo resonator may have fixed inner and outer resonator shells, which are attached to the banjo. Sandwiched between the inner and outer resonator shells would be a movable interior resonator shell that serves the purpose of opening and closing holes in the resonator. In addition various means, as would be familiar to those skilled in the art, could be used to individually open or close holes in an adjustable enhanced banjo resonator.

What is claimed is:

1. An enhanced resonator for a banjo comprising:

a fixed outer shell having a plurality of openings therein;

an inner shell having a plurality of openings therein;

said inner shell rotatably coupled within said outer shell such that the openings of said outer and inner shell are selectively moved into and out of alignment to vary the amount of sound able to emanate from the resonator;

means for fixing said inner and outer shells relative to each other; and, means for attaching the outer shell to said banjo.

* * * * *